US007925197B2

(12) United States Patent
Takagi et al.

(10) Patent No.: US 7,925,197 B2
(45) **Date of Patent: *Apr. 12, 2011**

(54) FIXING APPARATUS OF IMAGE FORMING APPARATUS

(75) Inventors: Osamu Takagi, Chofu (JP); Satoshi Kinouchi, Shinjuku-ku (JP); Yoshinori Tsueda, Fuji (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 693 days.

This patent is subject to a terminal disclaimer.

(21) Appl. No.: 11/942,084

(22) Filed: Nov. 19, 2007

(65) Prior Publication Data

US 2008/0118282 A1 May 22, 2008

Related U.S. Application Data

(60) Provisional application No. 60/866,671, filed on Nov. 21, 2006.

(51) Int. Cl.
*G03G 15/20* (2006.01)

(52) U.S. Cl. ..... 399/329

(58) Field of Classification Search ..... 399/320, 399/328, 329, 335

See application file for complete search history.

(56) References Cited

U.S. PATENT DOCUMENTS

| | | | | |
|---|---|---|---|---|
| 6,898,409 | B2 | 5/2005 | Tsueda et al. | |
| 7,257,361 | B2 | 8/2007 | Takagi et al. | |
| 7,672,632 | B2 * | 3/2010 | Sone et al. | 399/329 |
| 2007/0246457 | A1 | 10/2007 | Tsueda et al. | |
| 2007/0248388 | A1 * | 10/2007 | Tsueda et al. | 399/328 |
| 2008/0118262 | A1 | 5/2008 | Kinouchi et al. | |
| 2008/0118283 | A1 | 5/2008 | Tsueda et al. | |
| 2008/0124109 | A1 | 5/2008 | Sone et al. | |

FOREIGN PATENT DOCUMENTS

| | | |
|---|---|---|
| JP | 11-030924 | 2/1999 |
| JP | 2002-295452 | 10/2002 |
| JP | 2005-345850 | 12/2005 |

* cited by examiner

*Primary Examiner* — David M Gray
*Assistant Examiner* — Andrew V Do
(74) *Attorney, Agent, or Firm* — Turocy & Watson, LLP

(57) ABSTRACT

A heat roller of a fixing apparatus according to an embodiment of the invention has a slidable metal belt on an outer side of an elastic roller. At the room temperature, the outer diameter of the elastic roller is smaller than the inner diameter of the metal belt. On the other hand, when the elastic roller is thermally expanded, the metal belt and the elastic roller fit onto each other in a state in which the metal belt fastens the elastic roller.

5 Claims, 4 Drawing Sheets

( POWER OF 900 W IS SUPPLIED TO
INDUCTION CURRENT GENERATING COIL )

FIXING APPARATUS OF IMAGE FORMING APPARATUS

CROSS REFERENCE TO RELATED APPLICATION

This invention is based upon and claims the benefit of priority from prior U.S. Patent Application 60/866,671 filed on Nov. 21, 2006, and the entire contents of which are incorporated herein by reference.

BACKGROUND OF THE INVENTION

1. Field of the Invention

The present invention relates to a fixing apparatus provided in an image forming apparatus, such as a copying machine, a printer, and a facsimile, and a roller used in the fixing apparatus, and in particular, a fixing apparatus of an image forming apparatus and a roller using an induction heating system.

2. Description of the Background

In a fixing apparatus that adopts an induction heating system and is used in an image forming apparatus, such as an electrophotographic copying machine or printer, there is a device that increases the fixing speed by speeding up a warming up time of the fixing apparatus. For example, JP-A-2002-295452 discloses a heating device that heats a metal sleeve, which is positioned on the outer periphery of an elastic layer of a heat roller and has a small heat capacity, using an induction coil to thereby shorten a warming-up time.

However, in the known device, handling of expansion or contraction that occurs to the elastic layer when warming up or cooling the elastic layer is not mentioned.

Therefore, in a case when a metal belt having a metal layer on the outer periphery of an elastic layer is provided, it is preferable to develop a fixing apparatus of an image forming apparatus capable of increasing the life of the metal belt and an elastic roller by preventing the metal belt or the elastic layer from being broken at an early stage regardless of expansion or contraction occurring to the elastic layer.

SUMMARY OF THE INVENTION

It is an aspect of the invention to provide a highly reliable fixing apparatus of an image forming apparatus capable of increasing the life of an elastic layer and a metal belt by preventing the metal belt positioned on the outer periphery of an elastic roller from deforming to be damaged in a case in which the elastic layer on a surface of the elastic roller expands or contracts or by preventing the elastic layer from being damaged at ends of the metal belt when the metal belt moves in a zigzag manner.

According to an embodiment of the present invention, a fixing apparatus of an image forming apparatus includes: a metal belt having a metal layer; an elastic roller which is disposed on an inner side of the metal belt and has an elastic layer, which is thermally expanded, provided on a surface thereof, and whose outer diameter when the temperature of the elastic layer is 25° C. is smaller than the inner diameter of the metal belt and whose outer diameter when the temperature of the elastic layer is a fixable temperature is larger than the inner diameter of the metal belt; an opposite member that is opposite to the elastic roller with the metal belt interposed therebetween and nips the metal belt together with the elastic roller; and an induction current generator that performs induction heating on the metal layer.

DETAILED DESCRIPTION OF THE INVENTION

Figure 1:
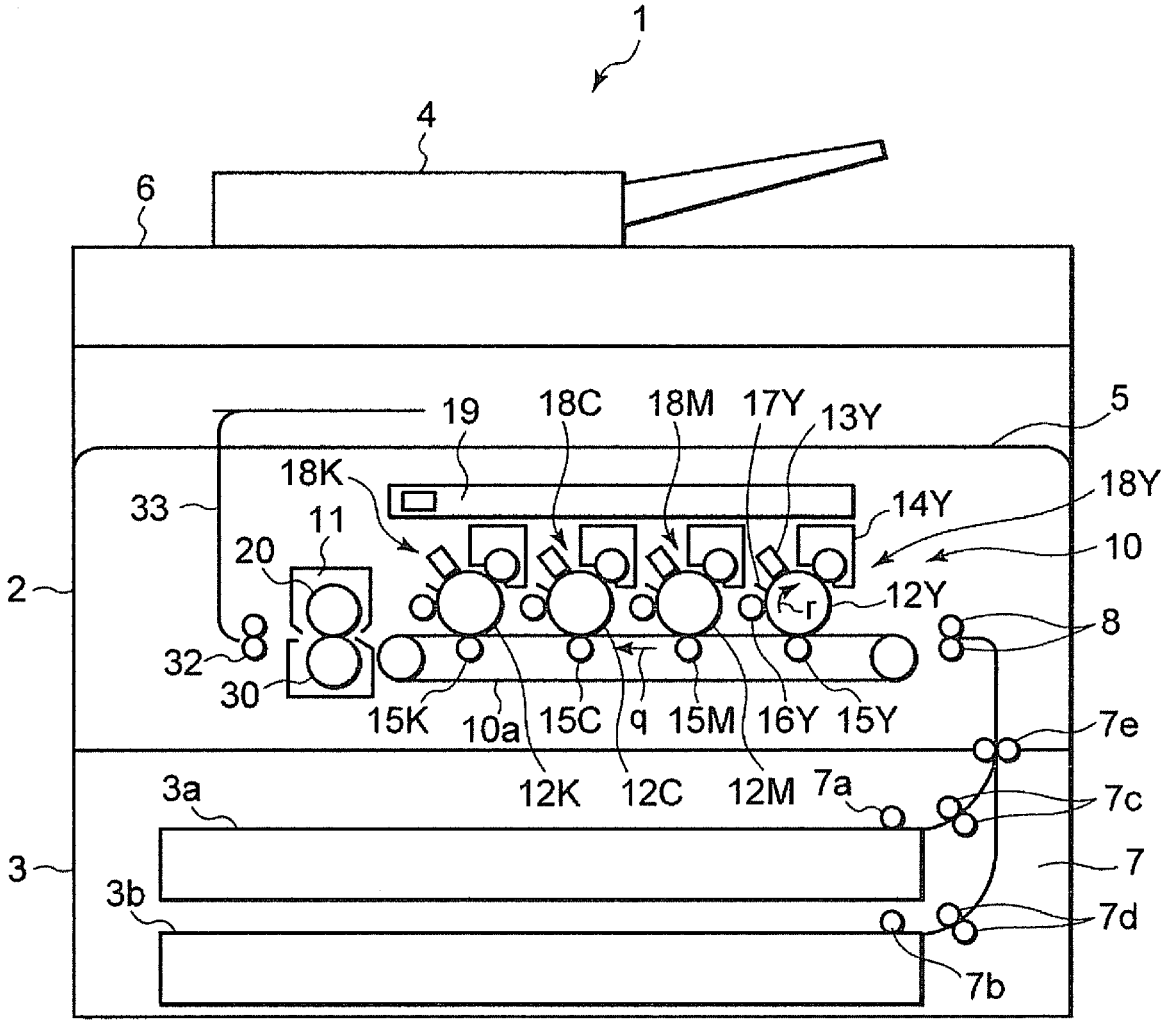
FIG. 1 is a view schematically illustrating the configuration of an image forming apparatus according to an embodiment of the invention.

Hereinafter, an embodiment of the invention will be described in detail using the accompanying drawings as an example. FIG. 1 is a view schematically illustrating the configuration of an image forming apparatus 1 according to the embodiment of the invention. The image forming apparatus 1 includes a scanner unit 6 that reads an original document and a paper feed unit 3 that feeds sheet paper P, which is a recording medium, to a printer unit 2 that forms an image. The scanner unit 6 converts image information, which is read from the original document fed by an automatic document feed unit 4 provided on an upper surface of the scanner unit 6, into an analog signal.

The printer unit 2 includes an image forming unit 10 in which image forming stations 18Y, 18M, 18C, and 18K corresponding to colors of yellow (Y), magenta (M), cyan (C), and black (K) are arranged in tandem along a transfer belt 10*a* rotating in the direction of arrow q. In addition, the image forming unit 10 includes a laser exposure device 19 that irradiates laser beams, which correspond to image information, onto photoconductive drums 12Y, 12M, 12C, and 12K of the image forming stations 18Y, 18M, 18C, and 18K corresponding to respective colors. In addition, the printer unit 2 includes a fixing apparatus 11 and a paper discharge roller 32 and has a paper carrying path 33 along which the sheet paper P after fixing is carried to a paper discharge unit 5.

The image forming station 18Y of the image forming unit 10 corresponding to yellow (Y) includes an electric charger 13Y, a developer 14Y, a transfer roller 15Y, a cleaner 16Y, and a charge remover 17Y disposed around the photoconductive drum 12Y rotating in the direction of arrow r. The image forming stations 18M, 18C, and 18K corresponding to the colors of magenta (M), cyan (C), and black (K) are configured in the same manner as the image forming station 18Y corresponding to yellow (Y).

The paper feed unit 3 includes first and second paper feed cassettes 3*a* and 3*b*. Pickup rollers 7*a* and 7*b* that takes out the sheet paper P from the paper sheet cassettes 3*a* and 3*b*, separable carrying rollers 7*c* and 7*d*, a carrying roller 7*e*, and a resist roller 8 are provided on a carrying path 7 of the sheet paper P from the paper feed cassettes 3*a* and 3*b* to the image forming unit 10.

By the start of a print operation, the photoconductive drum 12Y rotates in the direction of arrow r and uniformly charged by the electric charger 13Y in the image forming station 18Y of the printer unit 2 corresponding to yellow (Y). Then, exposure corresponding to yellow (Y) image information read by the scanner unit 6 is performed on the photoconductive drum 12Y by the laser exposure device 19, such that an electrostatic latent image is formed. Then, toner is supplied onto the photoconductive drum 12Y by the developer 14Y, such that a yellow (Y) toner image is formed on the photoconductive drum 12Y. The yellow (Y) toner image is transferred onto the sheet paper P, which is carried in the direction of arrow q on the transfer belt 10*a*, at the position of the transfer roller 15Y. After transferring of the toner image is completed, toner remaining on the photoconductive drum 12Y is cleaned by the cleaner 16Y and electric charges on a surface of the photoconductive drum 12Y are removed by the charge remover 17Y, such that next printing becomes possible.

Also in the image forming stations 18M, 18C, and 18K corresponding to the colors of magenta (M), cyan (C), and black (K), toner images are formed in the same manner as the image forming station 18Y corresponding to yellow (Y) The toner images, which correspond to the respective colors, formed in the image forming stations 18M, 18C, and 18K are sequentially transferred onto the sheet paper P, on which the yellow toner image is formed, at the positions of the transfer rollers 15M, 15C, and 15K. The sheet paper P on which a color toner image is formed as described above is fixed by heating and pressing of the fixing apparatus 11, and thus a print image is completed. Then, the sheet paper P is discharged to the paper discharge unit 5.

Figure 2:
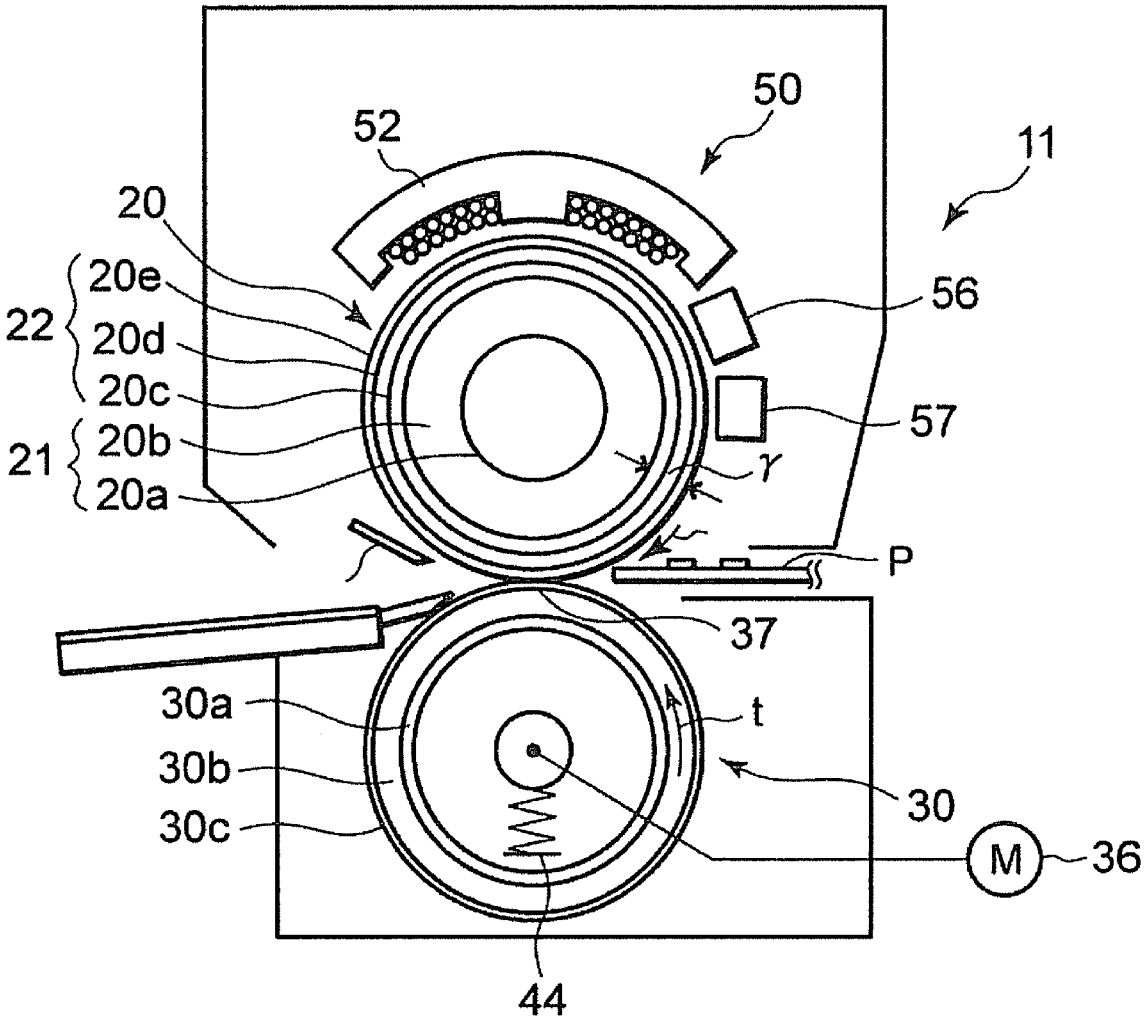
FIG. 2 is a view schematically illustrating the configuration of a fixing apparatus according to the embodiment of the invention as viewed from an axial direction.

Next, the fixing apparatus 11 will be described. FIG. 2 is a view schematically illustrating the configuration of the fixing apparatus 11 as viewed from an axial direction. The fixing apparatus 11 has a heat roller 20 and a press roller 30 that is an opposite member. The outer diameter of each of the heat roller 20 and the press roller 30 is set to about 40 to 55 mm, for example.

The press roller 30 is pressed against and in contact with the heat roller 20 by means of a pressing mechanism having a spring 44. Thus, a nip 37 having a predetermined width is formed between the heat roller 20 and the press roller 30.

Figure 3:
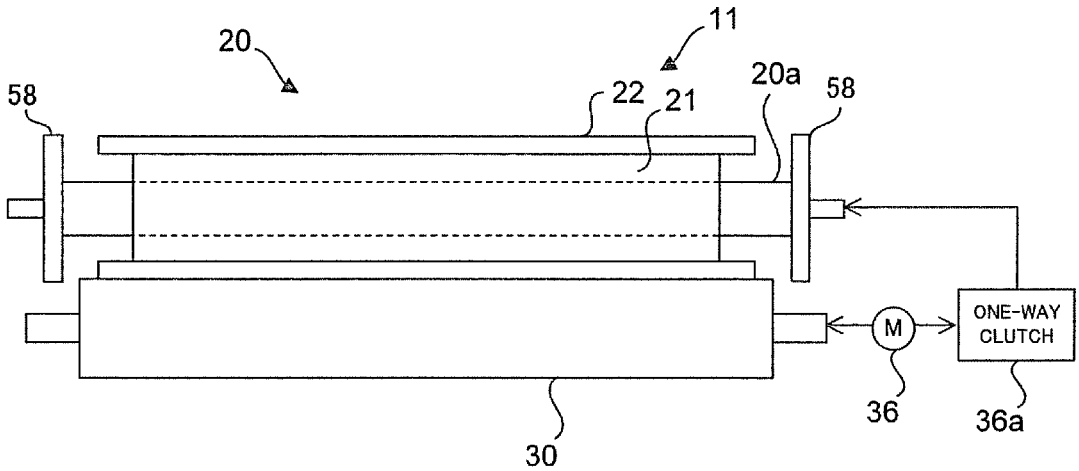
FIG. 3 is a view schematically explaining a heat roller and a press roller in the embodiment of the invention, as viewed from a direction parallel to an axis.

The press roller 30 is driven in the direction of arrow t by means of a driving motor 36. The heat roller 20 is driven by the press roller 30 and rotates in the direction of arrow s. Driving of the driving motor 36 is transmitted to the heat roller 20 through a one-way clutch 36*a*, as shown in FIG. 3. The one-way clutch 36*a* transmits driving of the driving motor 36 to the heat roller 20 when rotation of the heat roller 20 that is driven by the press roller 30 is delayed.

When driving of the driving motor 36 is transmitted to the heat roller 20 using the one-way clutch 36*a* through a link mechanism, the heat roller 20 is rotated in a constant speed together with the press roller 30. Then, when the rotation speed of the heat roller 20 is recovered, transmission of driving of the driving motor 36 to the heat roller 20 using the one-way clutch 36*a* is stopped. This removes a difference between rotation speeds of the heat roller 20 and the press roller 30. The heat roller 20 and the press roller 30 nip the sheet paper P with the nip 37 and carry the sheet paper P in the direction of the paper discharge roller 32. The sheet paper P passes through the nip 37 between the heat roller 20 and the press roller 30, such that a toner image on the sheet paper P is fixed by heating and pressing.

The heat roller 20 has an elastic roller 21 and a metal belt 22. The elastic roller 21 has a metal shaft 20*a* formed of iron (Fe) or aluminum, for example, and a foam silicon rubber layer 20*b* that serves as an elastic layer disposed on the periphery of the metal shaft 20*a* and has a radial thickness of 10 mm, for example. The foam silicon rubber layer 20*b* is formed by using open cell micro cellular foam having an average cell diameter of about 150 micron, for example.

The metal belt 22 is formed by providing a silicon rubber layer 20*d* having a thickness of 200 μm, for example, which is a rubber layer, on a surface of a metal conductive layer 20*c* that is made of a nickel (Ni), for example, and is a metal layer having a thickness of 40 μm and by further laminating a release layer 20*e* on a surface of the silicon rubber layer 20*d*. The release layer 20*e* is formed by using a fluorine resin (PFA or PTFE (polytetrafluoroethylene) or mixture of PFA and PTFE), for example. In addition, the metal layer is not limited to nickel, but stainless steel, aluminum, or mixture of stainless steel and aluminum may be used. In addition, the metal layer may be formed by forming a resin containing conductive powder in the shape of a layer.

The metal shaft 20*a* and the foam silicon rubber layer 20*b* of the elastic roller 21 are fixed to each other. The metal conductive layer 20*c* and the silicon rubber layer 20*d* of the metal belt 22 are fixed to each other, and the silicon rubber layer 20*d* and the release layer 20*e* are fixed to each other. However, the foam silicon rubber layer 20*b* and the metal conductive layer 20*c* do not adhere to each other. Therefore, since the metal belt 22 is not adhered and fixed to the elastic roller 21, the metal belt 22 can freely slide on the elastic roller 21.

Figure 4:
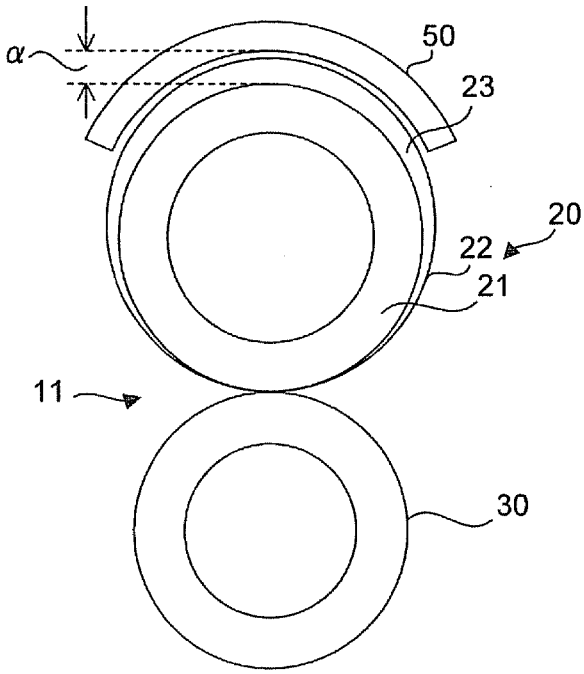
FIG. 4 is an explanatory view schematically illustrating an elastic roller and a metal belt at the room temperature in the embodiment of the invention.

At the room temperature (25° C.), the outer diameter of the elastic roller 21 is smaller than the inner diameter of the metal belt 22 by about 0.2 to 0.7 mm. Accordingly, at the room temperature (25° C.), air flows through a space 23 between the elastic roller 21 and the metal belt 22, as shown in FIG. 4. Moreover, the elastic roller 21 is thermally expanded by heating. For example, a surface of the heat roller 20 is set to have a fixable temperature of 160° C. and is then placed in this state. Then, the foam silicon rubber layer 20*b* is gradually expanded in the direction from the vicinity of the surface to the inside. For example, the foam silicon rubber layer 20*b* having a thickness of 10 mm is gradually heated at 160° C. and is expanded up to a thickness of 11 mm.

Figure 5:
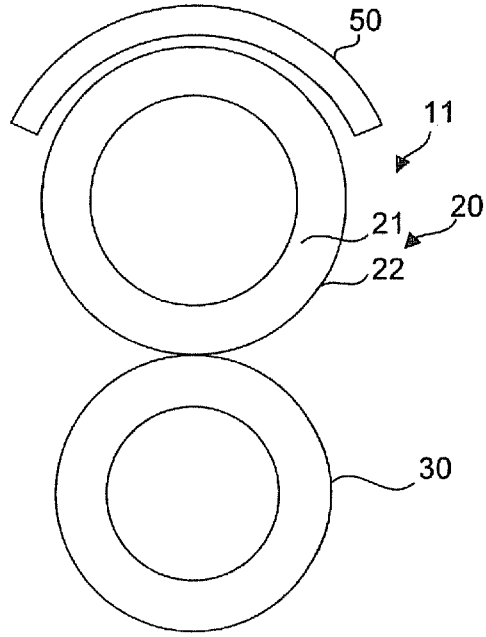
FIG. 5 is an explanatory view schematically illustrating an elastic roller and a metal belt when the elastic roller is thermally expanded in the embodiment of the invention.

Accordingly, during a period of time for which the image forming apparatus 1 is set to a standby mode, in which the heat roller 20 is maintained to have 160° C. that is a fixable temperature, after warming up, the foam silicon rubber layer 20*b* is gradually expanded. Then, the outer diameter of the elastic roller 21 becomes larger than the inner diameter of the metal belt 22 by about 0.2 to 0.5 mm. As a result, pressure occurring due to the elastic roller 21 is applied to an inner side of the metal belt 22. Then, as for the elastic roller 21 and the metal belt 22, the metal belt 22 firmly fits onto the elastic roller 21 in a state in which the metal belt 22 comes to fasten the elastic roller 21, as shown in FIG. 5.

The press roller 30 is formed by coating, for example, a silicon rubber layer 30*b* and a release layer 30*c* on the periphery of a hollow metal shaft 30*a*. The thickness and the like of the silicon rubber layer 30*b* of the press roller 30 are not limited. The metal shaft 30*a* and the silicon rubber layer 30*b* are fixed to each other with an adhesive or the like, and the silicon rubber layer 30*b* and the release layer 30*c* are fixed to each other with an adhesive or the like.

A separation claw 54 that prevents curling of the sheet paper P after fixing, an induction current generating coil 50 that is an induction current generator that performs induction heating on the metal conductive layer 20*c* of the heat roller 20, a thermopile-type infrared sensor 56 that detects the surface temperature of the heat roller 20, and a thermostat 57 that detects abnormality of the surface temperature of the heat roller 20 and stops supply of power to the induction current generating coil 50 are provided around the outer periphery of the heat roller 20. The separation claw 54 may be of a contact type or a non-contact type.

The induction current generating coil 50 has a shape having approximately the same axis as the heat roller 20 and is formed by winding a wire material around a magnetic core 52 for focusing magnetic flux on the heat roller 20. For example, the Litz wire obtained by tying a plurality of copper wires, each of which is coated with heat-resistant polyamidoimide and which are insulated from each other, is used as a wire material. By using the Litz wire as a wire material, it is possible to make the diameter of the wire material smaller than the depth of penetration of a magnetic field. This allows a high-frequency current to effectively flow through the wire material.

The induction current generating coil 50 is provided on the outer periphery of the heat roller 20 so as to have a predetermined gap $\alpha$ between the induction current generating coil 50 and the heat roller 20 and causes the metal conductive layer 20*c* of the heat roller 20 to generate heat. At the room temperature (25° C.), the heat roller 20 has a shape shown in FIG. 4. That is, when the inner diameter of the metal belt 22 is larger than the outer diameter of the elastic roller 21, only a portion of the metal belt 22 nipped between the heat roller 20 and the press roller 30 is regulated. Accordingly, the metal belt 22 easily bows toward the induction current generating coil 50 opposite the portion nipped between the heat roller 20 and the press roller 30.

Figure 6:
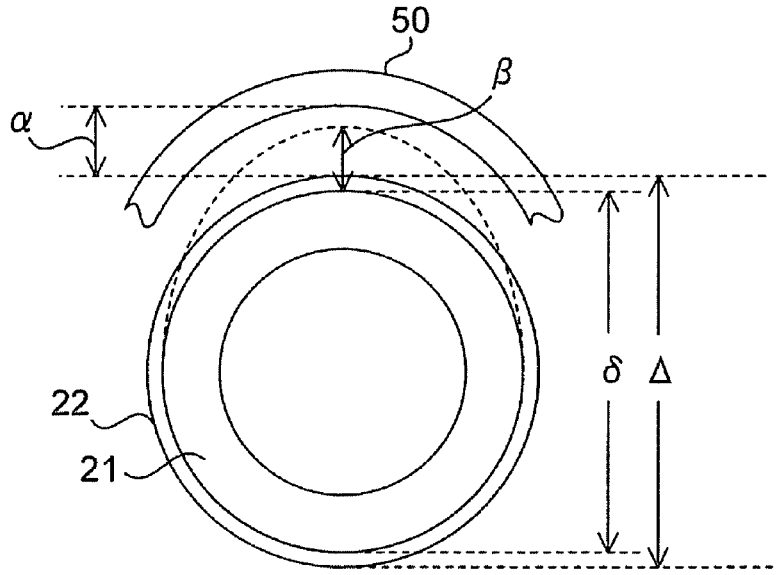
FIG. 6 is an explanatory view schematically illustrating bending of the metal belt in the embodiment of the invention.

For this reason, it is necessary to provide the gap $\alpha$ between the induction current generating coil 50 and the heat roller 20 such that the metal belt 22 in which bending occurs is not in contact with the induction current generating coil 50. At this time, the gap $\alpha$ is set assuming that all bending of the metal belt 22 occurs toward the induction current generating coil 50. For example, as shown in FIG. 6, assuming that the outer diameter of the elastic roller 21 is $\delta$ and the inner diameter of the metal belt 22 is $\Delta$, the metal belt 22 may have an elliptical shape that has the outer diameter $\delta$ of the elastic roller 21 as a short axis and is shown in a dotted line. A difference between long and short axes of the elliptical shape shown in the dotted line is a distance $\beta$ between the elastic roller 21 and the metal belt 22 shown in a dotted line in the long axis direction. Accordingly, if $\alpha>\beta+\gamma$ when the gap $\alpha$ is compared with a sum of the gap $\beta$ and the thickness $\gamma$ of the metal belt 22, there is no possibility that the induction current generating coil 50 and the metal belt 22 will become in contact with each other.

In the present embodiment, a gap between the heat roller 20, which includes the foam silicon rubber layer 20*b* having a thickness of about 10 mm and has an outer diameter of 40 to 55 mm, and the induction current generating coil 50 is about 2.5 to 3.5 mm, for example. However, the gap is not limited thereto. In order to improve a heating efficiency of the metal conductive layer 20*c* caused by the induction current generating coil 50, it is preferable that the gap between the heat roller 20 and the induction current generating coil 50 be small.

A flange 58, which is a regulating member for regulating that the metal belt 22 makes a sliding movement in the axial direction of the elastic roller 21 and is formed of a synthetic resin or the like, is attached on both sides of the metal shaft 20*a* of the heat roller 20, as shown in FIG. 3. Since the metal belt 22 is regulated by the flange 58, there is no case in which an edge of the metal belt 22 is not hung on the elastic roller 21 even if the metal belt 22 moves in a zigzag manner. As a result, the elastic roller 21 is not damaged due to the edge of the metal belt 22. The flange 58 is provided to freely rotate with respect to the metal shaft 20*a*. Thus, in the case when an end of the metal belt 22 is in contact with the flange 58, the flange 58 moves in conjunction with rotation of the metal belt 22. As a result, since a load applied to the end of the metal belt 22 can be reduced due to the flange 58, damage of the metal conductive layer 20*c* can be avoided.

Next, an operation will be described. First, a main switch of the image forming apparatus 1 is turned on to start warming up. At this time, the image forming apparatus 1 is set to have almost the room temperature (25° C.), and the layer thickness of the foam silicon rubber layer 20*b* of the elastic roller 21 is set to about 10 mm. As a result, the inner diameter of the metal belt 22 of the heat roller 20 is larger than the outer diameter of the elastic roller 21. Accordingly, the metal belt 22 bows toward the induction current generating coil 50, as shown in FIG. 4. However, since the induction current generating coil 50 is disposed to have the gap $\alpha$ between the induction current generating coil 50 and the heat roller 20 in consideration of bending of the metal belt 22, there is no possibility that the metal belt 22 will come in contact with the induction current generating coil 50.

By start of warming up, driving of the driving motor 36 is started and power of, for example, 900 W is supplied to the induction current generating coil 50. The press roller 30 is rotated in the direction of arrow t by driving of the driving motor 36, such that the heat roller 20 is driven in the direction of arrow s. Then, the metal belt 22 is nipped between the heat roller 20 and the press roller 30 to be carried in the direction of arrows. At this time, in the heat roller 20, the metal belt 22 does not fit onto the elastic roller 21. As a result, rotation delay occurs to the heat roller 20 driven by the press roller 30. In this case, if the driven rotation of the heat roller 20 is delayed as described above, the one-way clutch 36*a* operates to transmit driving of the driving motor 36 to the heat roller 20. This makes it possible that the heat roller 20 keeps uniform rotation together with the press roller 30. As a result, a fixing performance is improved.

Figure 7:
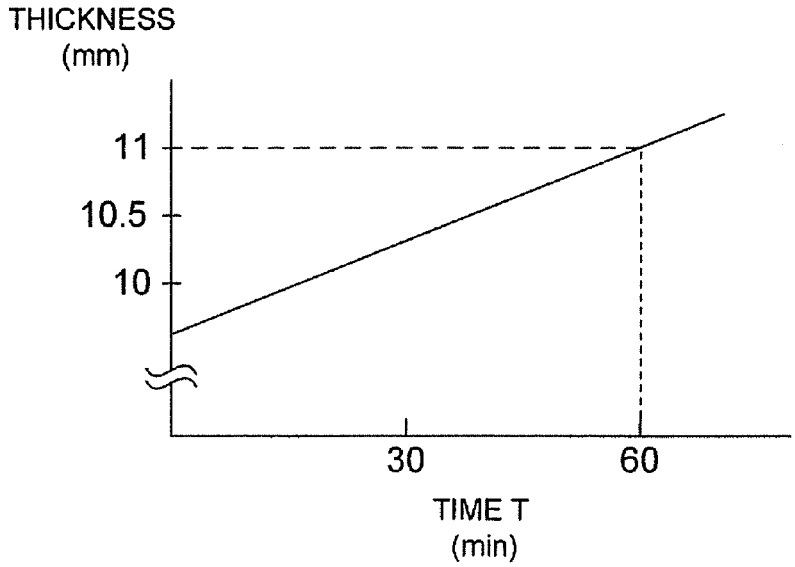
FIG. 7 is a graph illustrating the expansion size of a foam silicon rubber layer with respect to a heating time in the embodiment of the invention.

In the meantime, the metal conductive layer 20*c* is subjected to induction heating by means of the induction current generating coil 50 to which power of 900 W is supplied, and accordingly, the foam silicon rubber layer 20*b* of the elastic roller 21 is heated. In the present embodiment, expansion of the foam silicon rubber layer 20*b* in a case in which the foam silicon rubber layer 20*b* having a thickness of about 10 mm is heated by supplying an output of 900 W to the induction current generating coil 50 so as to heat the metal conductive layer 20*c* is shown in FIG. 7. As shown in FIG. 7, at the room temperature (25° C.), the foam silicon rubber layer 20*b* whose thickness was about 10 mm is expanded up to a thickness of 11 mm in about 60 (min).

When the foam silicon rubber layer 20*b* is heated to be thermally expanded as described above, the metal belt 22 comes to fasten the elastic roller 21, as shown in FIG. 5. If the metal belt 22 fits onto the elastic roller 21, the rotation speed of the heat roller 20 driven by the press roller 30 becomes almost equal to that of the press roller 30. When the rotation speed of the heat roller 20 becomes equal to that of the press roller 30, transmission of driving of the driving motor 36 to the heat roller 20 using the one-way clutch 36*a* is stopped.

When the surface temperature of the heat roller 20 reaches a fixable temperature, for example, 160° C. and warming-up is thus completed, the image forming apparatus 1 becomes in a standby mode (in the case when the fixable temperature is maintained and a print instruction is made, printing becomes possible immediately). In the standby mode, power supplied to the induction current generating coil 50 is feedback controlled in the fixing apparatus 11 such that the fixable temperature is maintained by causing the infrared sensor 56 to detect the surface temperature of the heat roller 20.

Even if the heat roller 20 reaches the fixable temperature, the foam silicon rubber layer 20*b* of the elastic roller 21 does not expand rapidly, but the space 23 still remains between the elastic roller 21 and the metal belt 22 for about one hour from the start of heating. That is, the metal belt 22 does not fit onto the elastic roller 21. For this reason, while the metal belt 22 is being carried in a state in which the metal belt 22 is nipped between the heat roller 20 and the press roller 30, there is a case in which the metal belt 22 moves in a zigzag manner in the axial direction of the heat roller 20. In this case, even if the metal belt 22 moves slightly in a zigzag manner, an edge of the metal belt 22 is in contact with the flanges 58 positioned at both sides of the metal shaft 20*a* of the heat roller 20. Accordingly, the zigzag movement of the metal belt 22 is regulated to a predetermined range. For this reason, there is no possibility that the edge of the metal belt 22 will cause damage to the elastic roller 21.

If printing is instructed during the standby mode, the image forming apparatus 1 starts a print operation so that the printer unit 2 forms a toner image on the sheet paper P. Subsequently, the sheet paper P having the toner image thereon is made to pass through the nip 37 between the heat roller 20 and the press roller 30, such that the toner image is fixed by heating and pressing.

In the meantime, if, for example, about an hour passes after the heat roller 20 reaches the fixable temperature, the foam silicon rubber layer 20*b* of the elastic roller 21 is expanded up to about 11 mm. That is, the outer diameter of the elastic roller 21 becomes larger than the inner diameter of the metal belt 22 by about 0.2 to 0.5 mm. As a result, pressure occurring due to the elastic roller 21 is applied to an inner side of the metal belt 22. In addition, as shown in FIG. 5, the metal belt 22 fits onto the elastic roller 21 in a state in which the metal belt 22 fastens the elastic roller 21. In the meantime, the space 23 between the elastic roller 21 and the metal belt 22 becomes small gradually. However, since the elastic roller 21 and the metal belt 22 do not adhere to each other, the air between the elastic roller 21 and the metal belt 22 flows through the space 23 and is then discharged from both sides of the metal belt 22. Accordingly, the metal belt 22 is not deformed (for example, the metal belt 22 is not curved) due to the air between the elastic roller 21 and the metal belt 22, regardless of expansion of the elastic roller 21.

When the metal belt 22 firmly fits onto the elastic roller 21, the metal belt 22 cannot make a sliding movement in the axial direction of the elastic roller 21. As a result, a possibility that the metal belt 22 nipped and carried between the heat roller 20 and the press roller 30 will move in a zigzag manner in a standby mode of the image forming apparatus or at the time fixing of the image forming apparatus disappears. Accordingly, since a load applied to the elastic roller 21, which occurs due to sliding of the metal belt 22, or a load applied to the metal belt 22 itself is reduced, it is possible to increase a life of the heat roller 20. As a result, a further stabilized fixing performance can be obtained.

Then, for example, if the image forming apparatus 1 changes to a sleep mode (in the case when a printing instruction is made while the surface temperature of the heat roller 20 is being maintained to be lower than the fixable temperature, the surface temperature of the heat roller 20 is immediately increased up to the fixable temperature) for saving the power consumption or a main switch is turned off, the foam silicon rubber layer 20*b* of the elastic roller 21 is cooled to contract. When the foam silicon rubber layer 20*b* starts to contract, the space 23 is generated again between the elastic roller 21 and the metal belt 22 and the air flows therethrough. For this reason, the metal belt 22 is not adhered to the elastic roller 21 at the time of contraction of the elastic roller 21. As a result, since there is no possibility that a cross section of the metal belt 22 is deformed into the polygonal shape by contraction of the elastic roller 21 to thereby cause stripe-shaped damage, it is possible to increase the life of the metal belt 22.

In the case when a usable time of the metal belt 22 is ended while fixing is being performed in this manner, the used metal belt 22 of the heat roller 20 is removed from the elastic roller 21 and a new metal belt is attached on the elastic roller 21 being used. Thus, since the metal belt 22 can be easily attached on the elastic roller 21 or easily detached from the elastic roller 21, it is possible to reuse the elastic roller 21. Replacement of the metal belt 22 is not limited to periodical replacement but may be occasionally performed if a trouble occurs. A trouble of the metal belt 22 may be detected through a mark or the like formed on the metal belt 22 by using a sensor and may be detected in an arbitrary way.

In the fixing apparatus 11 according to the present embodiment, the heat roller 20 is configured to include the elastic roller 21 that is expanded by heating and the metal belt 22 that can slide to the outside of the elastic roller 21. In addition, at the room temperature (25° C.), the outer diameter of the elastic roller 21 is smaller than the inner diameter of the metal belt 22. On the other hand, if a surface of the heat roller 20 is maintained to have the fixable temperature, the foam silicon rubber layer 20*b* of the elastic roller 21 is thermally expanded. Thus, since the metal roller 22 is not fixed to the elastic roller 21, air can flow through the space 23 between the elastic roller 21 and the metal belt 22 when the elastic roller 21 expands or contracts. As a result, since it is possible to prevent the metal belt 22 from deforming at the time of expansion or contraction of the elastic roller 21, it is possible to increase the life of the metal belt.

In addition, when the elastic roller 21 is thermally expanded, the metal belt 22 and the elastic roller 21 fit onto each other in a state in which the metal belt 22 fastens the elastic roller 21. Accordingly, it is possible to prevent the metal belt 22 from moving in a zigzag manner in the axial direction of the elastic roller 21 when the metal belt 22 is being carried in a state in which the metal belt 22 is nipped between the heat roller 20 and the press roller 30. As a result, since a load applied to the elastic roller 21 and the metal belt 22 due to the zigzag movement can be reduced, it is possible to increase the life of the heat roller and a further stabilized performance can be obtained. Furthermore, the metal belt 22 can be easily attached to the elastic roller 21 and detached from the elastic roller 21 at the time of contraction of the elastic roller 21. Therefore, it becomes easy to reuse the elastic roller 21 by replacing the metal belt 22.

In addition, the invention is not limited to the embodiment described above, but various modifications can be made within the scope of the invention. For example, a material or a structure of an elastic layer is arbitrary, the cell diameter of open cell foam is not limited, and closed cell foam may be used. In addition, a coefficient of thermal expansion or the expansion speed of the elastic layer is also arbitrary. In addition, the structures or sizes of the metal belt and the elastic roller are not limited. It is preferable that the metal belt can make a sliding movement on the elastic roller at the room temperature and the metal roller fit onto the elastic roller in a state in which the metal roller fastens the elastic roller when the elastic roller is thermally expanded. In addition, the opposite member may have a belt shape. In addition, a gap between the induction current generator and the elastic roller is not also limited, as long as the gap is within a range of not allowing a contact of a metal belt. Furthermore, the fixable temperature of the fixing apparatus is not limited.

What is claimed is:

1. A fixing apparatus comprising:

a metal belt having a metal layer;

an elastic roller which is disposed on an inner side of the metal belt and comprises an elastic layer, which is thermally expanded, on a surface thereof, and whose outer diameter when the temperature of the elastic layer is 25° C. is smaller than the inner diameter of the metal belt and whose outer diameter when the temperature of the elastic layer is a fixable temperature is larger than the inner diameter of the metal belt and configured to support the metal belt slideably;

an opposite member that is opposite to the elastic roller with the metal belt interposed therebetween and nips the metal belt together with the elastic roller; and an induction current generator that performs induction heating on the metal layer.

2. The fixing apparatus according to claim 1, further comprising:

a regulating member that is provided on both sides of the elastic roller to regulate a range of sliding of the metal belt.

3. A heat roller comprising:

an endless metal belt having a metal layer that is inductively heated; and an elastic roller which is disposed on an inner side of the metal belt and comprises an elastic layer, which is thermally expanded, on a surface thereof, and whose outer diameter when the temperature of the elastic layer is 25° C. is smaller than the inner diameter of the metal belt and whose outer diameter when the temperature of the elastic layer is a fixable temperature is larger than the inner diameter of the metal belt and configured to support the metal belt slideably.

4. The heat roller according to claim 3, further comprising:

a regulating member that is provided on both sides of the elastic roller to regulate a range of sliding of the metal belt.

5. A fixing method of a fixing apparatus comprising:

thermally expanding an elastic roller disposed on an inner side of a metal belt by heating a metal layer of the metal belt up to a fixable temperature with induction heating such that a state, in which the outer diameter of the elastic roller is smaller than the inner diameter of the metal belt, is changed to a state in which the outer diameter of the elastic roller is larger than the inner diameter of the metal belt;

nipping and carrying a recording medium between the metal belt and an opposite member, which can be pressed against and come in contact with the metal belt, and fixing a toner image on the recording medium;

contracting the elastic roller by stopping induction heating of the metal layer such that the outer diameter of the elastic roller becomes smaller than the inner diameter of the metal belt;

detaching the metal belt from the outer periphery of the elastic roller by causing the metal belt to slide when the elastic roller contracts such that the outer diameter of the elastic roller becomes smaller than the inner diameter of the metal belt; and disposing the elastic roller on an inner side of a new metal belt.

* * * * *